US005647237A

United States Patent [19]

Jungkunz et al.

[11] Patent Number: 5,647,237

[45] Date of Patent: Jul. 15, 1997

[54] PROCESS FOR SUPPRESSING THE INFLUENCE OF ROLL ECCENTRICITIES

[75] Inventors: Clemens Jungkunz, Erlangen; Siegbert Steidl, Herzogenaurach; Dietrich Wohld, Grossenseebach; Andre Berghs, Neunkirchen; Hans-Peter Troendle, Forchheim, all of Germany

[73] Assignee: Siemens Aktiengesellschaft, München, Germany

[21] Appl. No.: 508,641

[22] Filed: Jul. 28, 1995

[30] Foreign Application Priority Data

Jul. 28, 1994 [DE] Germany ..... 44 26 637.5

[51] Int. Cl.[6] ..... B21B 37/18

[52] U.S. Cl. ..... 72/9.2; 72/10.1; 72/13.7; 72/365.2

[58] Field of Search ..... 72/9.2, 9.5, 11.8, 72/12.1, 13.7, 365.2

[56] References Cited

U.S. PATENT DOCUMENTS

| | | | |
|---|---|---|---|
| 4,222,254 | 9/1980 | King, Jr. et al. | 72/6 |
| 4,531,392 | 7/1985 | Puda | 72/9.2 |
| 4,648,257 | 3/1987 | Oliver et al. | 72/16 |
| 4,691,547 | 9/1987 | Teoh et al. | 72/16 |
| 5,036,265 | 7/1991 | Weihrich et al. | 72/9.5 |

FOREIGN PATENT DOCUMENTS

| | | |
|---|---|---|
| 0 170 016 | 7/1988 | European Pat. Off. . |
| 16 02 046 | 7/1979 | Germany . |
| 33 31 822 | 4/1992 | Germany . |
| 1 580 066 | 11/1980 | United Kingdom . |
| WO94/06578 | 3/1994 | WIPO . |

OTHER PUBLICATIONS

Patent Abstracts of Japan, 80 M 296, JP-59-16616 A, Jan. 27, 1984.

*Primary Examiner*—Lowell A. Larson
*Assistant Examiner*—Thomas C. Schoeffler
*Attorney, Agent, or Firm*—Kenyon & Kenyon

[57] ABSTRACT

In a previous process, the influence of roll eccentricities on the output thickness of the rolled material in a roll stand is suppressed by simulating the output signal of an oscillator and supplying this value to a position or thickness control for the roll stand, where the frequency of the output signal is set according to the roll rotation speed. In the process according to the invention, the amplitude and phase of the output signal are set so that the exit thickness of the rolled material is measured with a measuring delay in relation to the thickness reduction in the roll gap. A difference signal is generated from the delayed roll screw-down signal and a measured thickness signal multiplied by the sum of one and the quotient of the rigidity of the rolled material and the roll stand. The output signal of the oscillator is corrected according to the difference between the output signal and the difference signal. The output signal is phase shifted by the amount of measurement delay for a forward slip.

18 Claims, 5 Drawing Sheets

PROCESS FOR SUPPRESSING THE INFLUENCE OF ROLL ECCENTRICITIES

BACKGROUND OF THE INVENTION

The present invention pertains to a process for suppressing the influence of roll eccentricities on the strip thickness of the rolled material in a roll stand.

Eccentricities that influence the quality of the strip to be rolled are often found in rolling stands due to unevenly machined backup rolls or inaccurate bearing alignment. These eccentricities are manifested in the strip with the rotational speed of the roll affected by the eccentricity, usually the backup roll, depending on the rigidity of the roll stand and the material to be rolled. The frequency spectrum of the eccentricities and their negative influence on the strip includes basically the fundamental frequencies of the upper and lower backup roll; although there are also higher harmonic frequencies, these only appear with reduced amplitudes. Due to the slightly different diameters and rotational speeds of the upper and lower backup rolls, the frequencies of these backup rolls may differ.

In a process described in European Patent B-0 170 016, the roll eccentricities of the upper and lower backup rolls are simulated through the sum of the output signals of two oscillators connected in a feedback loop, and supplied to a position or thickness control for the roll stand to suppress the influence of roll eccentricities on the exit thickness of the rolled material. The oscillators work by the monitor principle, where the frequencies of their output signals are set according to the measured rotational speed of the rolls; the amplitude and phase of the output signals are corrected according to the difference between the summed output signal of the two oscillators and another sum signal obtained from the measured rolling force multiplied by the sum of inverse values of the roll stand's and the rolled material's rigidity and the measured actual value of the roll screw-down. The oscillators can be implemented as digital filters connected to the other analog position or thickness control of the roll stand through analog/digital converters and digital/analog converters. Assuming that the dynamics of position control (i.e., the dynamics of the control circuits and actuators used for regulating the screw-down position of the rolls) are negligible, the process in this European patent provides proper compensation for roll eccentricity. The measurement of the rolling force and thus the compensation for roll eccentricity, however, can be influenced by friction in the roll stand.

In a process described in U.S. Pat. No. 4,648,257 for compensating for roll eccentricities, the thickness of the rolled material is measured after its exit from the roll stand and used, together with the measured instantaneous rotation angle of at least one roll, for the ongoing calculation of estimated values for thickness changes in the rolled material. These estimated values are corrected, on the basis of the measurement delay, resulting from the distance of the thickness measurement point from the roll gap (i.e., the point of thickness change of the rolled material) convened into the corresponding rotation angle of the roll. The corrected estimated values, referenced to the rotation angle, are then supplied to the position or thickness control to compensate for eccentricities. The exact determination of the instantaneous rotation angle of the rolls is, however, considered relatively difficult especially due to the rough environment around the roll stand.

An object of the present invention is to provide a process for compensating for roll eccentricities without the need for measuring the rolling force or the instantaneous rotation angle of the rolls.

SUMMARY OF THE INVENTION

This and other objects are achieved according to the present invention by simulating the roll eccentricities through the output signal of a first oscillator connected in a feedback loop. The output signal of this oscillator is supplied to a position or thickness control for the roll stand to suppress the influence of roll eccentricities on the exit thickness of the rolled material in the roll stand. The frequency of this output signal is set according to the measured rotation speed of the rolls in the roll stand and the amplitude and phase of the output signal is set so that the thickness of the rolled material after its exit from the roll stand is measured with a delay in relation to the thickness reduction occurring in the roll stand. A signal corresponding to the roll screw-down is generated, delayed at least approximately by the amount of the delay of the measurement. A difference signal is generated from the delayed roll screw-down signal and the measured thickness signal multiplied by the sum of one and the quotient of the rigidity of the rolled material and the rigidity of the roll stand. The amplitude and phase of the first oscillator output signal are corrected according to the difference between the output signal and the difference signal in order to minimize this difference. Also, the output signal of the first oscillator is phase shifted by an amount corresponding to the measurement delay in order to achieve a forward slip.

Therefore, contrary to the process described in European Patent B-0 170 016, the thickness of the rolled material after its exit from the roll stand is measured instead of the rolling force, and this thickness is converted into an estimate of the roll eccentricities using gaugemeter equations. The fundamental frequency of the estimated roll eccentricities is simulated by the oscillator and supplied to the position or thickness control. The measurement delay in relation to the rolling gap where the thickness reduction takes place and the eccentricities affect the thickness of the rolled material occurring when measuring the thickness of the rolled material is canceled out during eccentricity compensation by the forward slipping phase shift of the sinusoidal oscillator output signal. For an oscillator consisting (as shown in FIG. 3 of European Patent B-0 170 016) of two integrators and supplying a sinusoidal and a cosinusoidal signal, this phase shift is expressed simply as $\sin(\omega t+\phi)=\cos\phi\cdot\sin\omega t+\sin\phi\cdot\cos\omega t$.

The set value of the roll screw-down, rather than its actual value, can be used as the roll screw-down signal. This allows exact (i.e., full) compensation for the roll eccentricities even in the case of slower and/or not exactly known dynamics of the position control. With progressively slower dynamics of the position control, only the adjustment time for compensating for the roll eccentricities is thus extended.

The insensitivity of the eccentricity compensation in relation to the dynamics of position control, however, no longer applies in the case of high roll speeds, since high speeds and, at the same time, slower dynamics of the position control may make the entire control circuit unstable. In order to avoid this effect, the disturbance monitor formed by the oscillator can be extended with the dynamics of the position control. It is, however, simpler to supply a dynamic correction for the position control delay through a proportional-differential controller (PD controller) on top of the thickness measurement signal used for generating the difference signal. Alternatively, the phase-shifted output signal of the oscillator can be supplied to the position or thickness control through a proportional-differential element (PD element), with the roll screw-down signal used for generating the difference signal also being supplied through a proportional delay element (PT1 element).

A direct digital design of the position or thickness control and the oscillator is preferably used with the roll screw-down signal, with the thickness measurement signal and the measured rotation speed of the roll being, or being converted to, digital values. Contrary to a quasi-continuous design, as proposed in the aforementioned European Patent B-0 170 016 for the oscillators used there, in direct digital control (DDC), a process computer system directly affects the actuators of the controlled system. Therefore, no additional hardware is needed for implementing the disturbance monitor (oscillator), and the set value of the roll screw-down preferably used for correcting the oscillator, in contrast to the actual value in the prior art process according to European Patent B-0 170 016, is available as a digital value, so that an analog/digital conversion is not needed and the associated, mainly dynamic, errors cannot occur. In contrast to a quasi-continuous design, in direct digital control, the amplitude and phase of the roll eccentricity are correctly simulated even in the case of a sampling frequency of the disturbance monitor (oscillator) that is not substantially higher than the roll speed, i.e., for example, in the case of a sampling frequency only 5 to 10 times higher.

Assuming, for the sake of simplicity, that the upper and lower rolls of the roll stand have the same speed, a single oscillator can be used for simulating eccentricity. However, since the speeds of the upper and lower rolls are actually different—although only slightly different—a second oscillator connected in a feedback loop is preferably used with the frequency of the output signal of the first oscillator being set according to the speed of the upper roll and the frequency of the output signal of the second oscillator being set according to the speed of the lower roll of the roll stand and with the output signals of the two oscillators being added together. The two oscillators can also be connected in serial.

In order to suppress the higher order frequencies of the roll eccentricities, third and fourth oscillators connected in a feedback loop can be used, which can also be connected in serial or their output signals can be added together. According to an advantageous improvement of the method of the present invention, it is combined with the process shown in European Patent B-0 170 016 by simulating the roll eccentricities with the output signal of at least one additional oscillator, which can be supplied to the position or thickness control. The frequency of the output signal is set according to the measured roll speed and the amplitude and phase of the output signal being supplied according to the difference between the output signal of the oscillator and the sum signal of the measured rolling force multiplied by the sum of the inverse values of the rigidities of the roll stand and the rolled material, and the roll screw-down in order to minimize this difference. Also in this case, the set value of the roll screw-down is preferably used to determine the difference.

DETAILED DESCRIPTION

Figure 1:
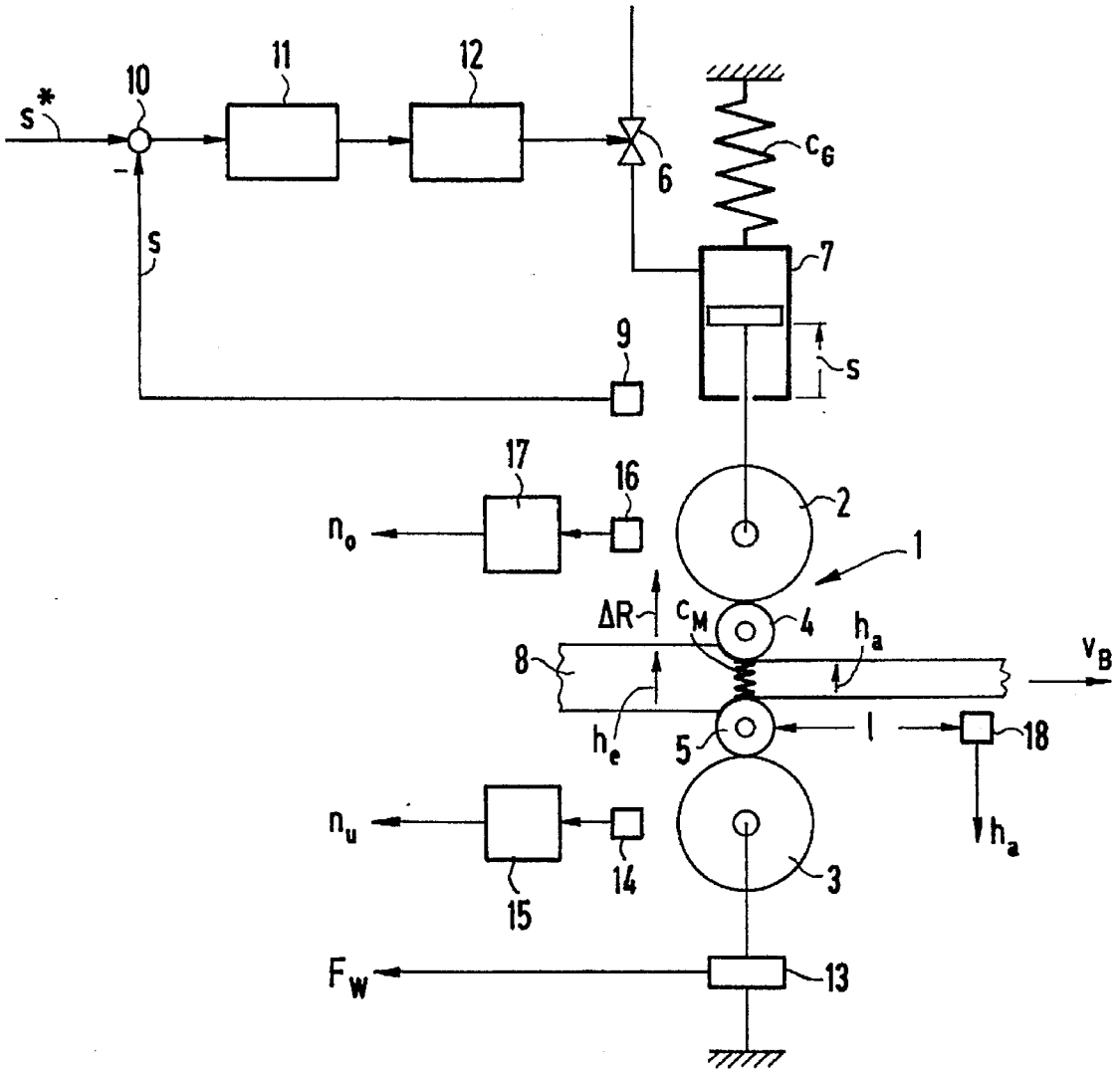
FIG. 1 is an example of the position control of a roll stand.

FIG. 1 shows an example of a position control of a roll stand 1 with an upper and lower backup roll 2 and 3, respectively, two work rolls 4 and 5, a hydraulic screw-down device 7 actuated through a control valve 6 for setting the roll screw-down value s and a spring $c_G$ symbolizing the elasticity of roll stand 1. The material to be rolled 8, to which an equivalent material spring $c_M$ can be assigned in the roll gap, is rolled through the two work rolls 4 and 5 from an entry thickness $h_c$ to an exit thickness $h_a$. The roll eccentricities can be described through the effective change in the roll radius $\Delta R$.

The roll screw-down value s is measured with a position sensor 9 on screw-down device 7 and compared as the actual value in a summator 10 to a set value s* of the roll screw-down, the result of the comparison being used through a position control device 11 and a downstream actuator 12 for actuating control valve 6 and, thus, for setting the roll screw-down value s.

As further described below, the exit thickness $h_a$ and the roll speed n, as well as (in the case of the embodiment illustrated in FIG. 3) rolling force $F_w$ must be measured to compensate for roll eccentricities $\Delta R$. Rolling force $F_w$ is measured using a pressure sensor 13 on roll stand 1. The measurement of roll speed n is used for determining the fundamental frequency of the roll eccentricities. Assuming, for the sake of simplicity, that the upper and lower rolls of roll stand 1 rotate at the same speed, it is sufficient to determine the speed of one driven roll (e.g., work roll 5) using tachometer 14. If, as in most cases, backup rolls 2 and 3 are the rolls affected by eccentricity, the measured speed of work roll 5 is converted into speed $n_u$ of lower backup roll 3 using the ratio of the diameter of work roll 5 to that of backup roll 3 in a unit 15. Since, as a rule, the speeds of the upper and lower rolls are different due to their slightly different diameters, in the embodiment shown, another tachometer 16 is provided with a downstream conversion unit 17 for determining speed $n_o$ of upper backup roll 2.

The exit thickness $h_a$ of the rolled material 8 is measured with a thickness measuring device 18, which is arranged at a distance 1 behind the rolling gap.

Figure 2:
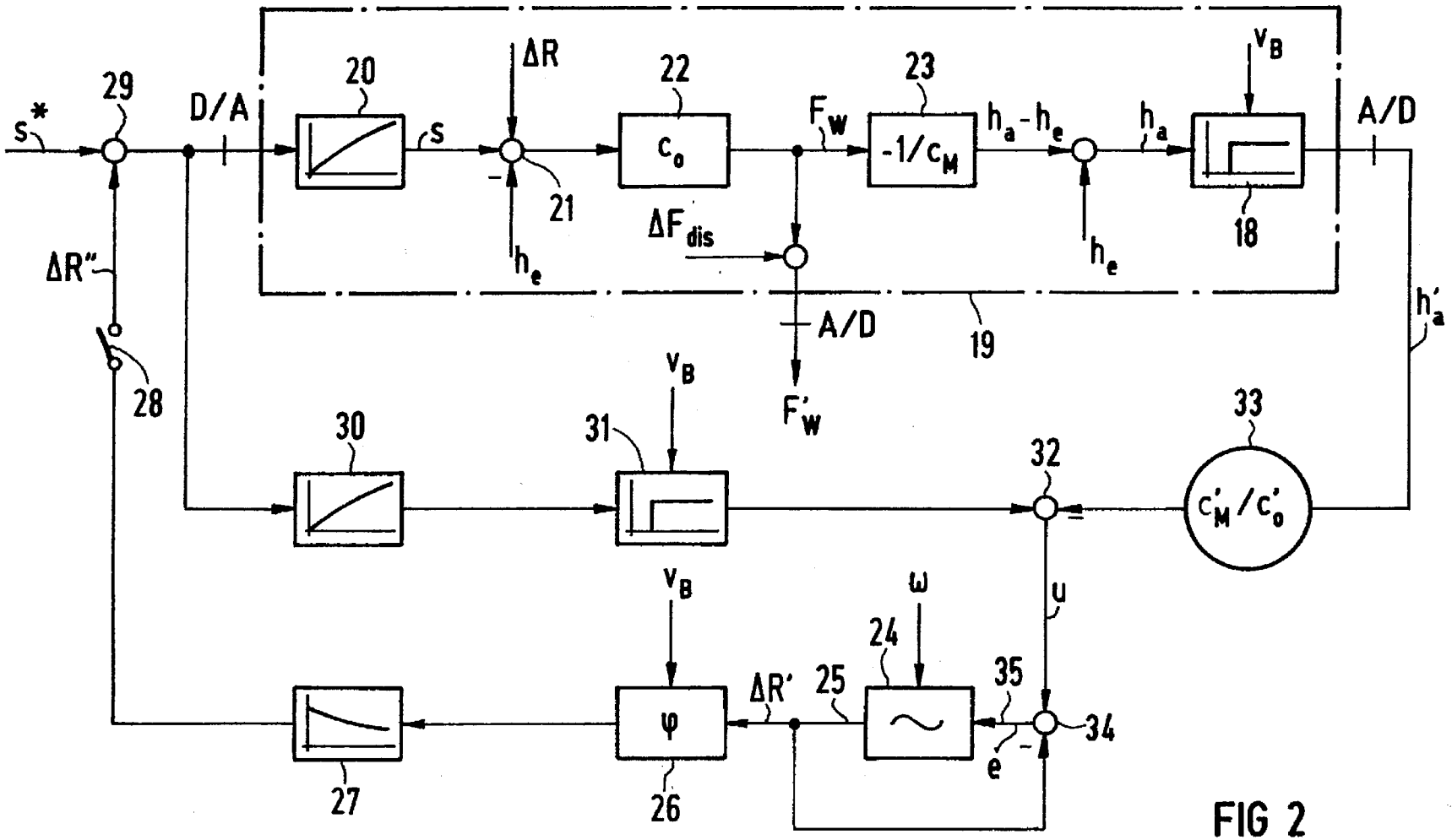
FIG. 2 is a block diagram of the controlled system formed by the position control and the roll stand of FIG. 1 with a disturbance monitor operating according to the process of the invention.

In FIG. 2, reference number 19 denotes a simplified block diagram of the controlled system shown in FIG. 1 comprising the position control and the roll stand. Position control 20 comprises, among other things, position controller 11 with summator 10, actuator 12, valve 6, and hydraulic screw-down device 7 with the roll mass it moves. Position control 20 provides the actual value s of the roll screw-down as an initial value. From FIG. 1 the following relationships can be derived for rolling force $F_w$:

$$F_W = c_G(h_c + \Delta R - s)$$

and $$F_W = c_M(h_c - h_a)$$

This provides the following relationships:

$$F_W = c_G(h_c + \Delta R - s)$$

where $c_O=c_Mc_G/(c_M+c_G)$ and $$h_a-h_c=-F_W/c_M,$$

which is illustrated in the block diagram of controlled system 19 by summator 21 with input values $h_c$, $\Delta R$, and $-s$; downstream function block 22 with overall rigidity $c_O$ of stand elasticity $c_G$ and material elasticity $c_M$; and the subsequent function block 23 with the negative inverse value of material elasticity $c_M$, arranged in series. At the exit of function block 22 appears rolling force $F_W$, whose measured value $F_W'$ is influenced by disturbances $\Delta F_{dis}$, such as friction in the roll stand. Due to the thickness reduction $h_a-h_c$ that appears at the exit of function block 23, the exit thickness $h_a$ of the rolled material 8 is obtained, measured with thickness measuring device 18 with a measuring delay dependent on exit speed $v_B$ of the rolled material 8 and distance 1 between the rolling gap and thickness measuring device 18.

A disturbance monitor, in the form of a negative feedback oscillator 24, is used to compensate for roll eccentricities $\Delta R$, which are assumed here to only have a fundamental frequency $\omega=2\pi n$, where $n=n_o=n_u$. In its steady state, the negative feedback oscillator 24 simulates the fundamental frequency of the disturbance (i.e. of roll eccentricities $\Delta R$) at its output 25. Frequency $\omega$ of oscillator 24 is set according to the measured roll speed n with $\omega=2\pi n$. Disturbance $\Delta R'$, simulated by oscillator 24, is supplied to a summator 29 via a phase rotator 26 which compensates for the measurement delay between the roll gap and the thickness measuring device 18; proportional-differential element (PD element 27); and switch 28, and is combined with set value s* of the roll screw-down value at the entry of the controlled system.

The set value of roll screw-down $s^*+\Delta R''$, superimposed to the simulated disturbance is supplied to summator 32 with a measurement delay at least approximately corresponding to the measurement delay of the thickness measuring device 18 through a proportional delay element (PT1) 30 complementary to PD element 27, and a delay element 31. The thickness measurement signal $h_a'$ output by thickness measuring device 18 is multiplied in a multiplicator 33 by the sum of one and the quotient of rigidities $c_M'$ and $c_G'$ of rolled material 8 and roll stand 1 (i.e., with $1+c_M'/c_G'=c_M'/c_O'$) and also supplied to summator 32 with a negative sign. Difference signal u generated in summator 32 and output signal $\Delta R'$ of oscillator 24 are compared in another summator 34, and a correction signal $e=u-\Delta R'$ is generated, through which oscillator 24 is phase and amplitude corrected at its input 35 until the simulated disturbance $\Delta R'$ and difference signal u are the same and thus the error becomes zero.

By supplying set value s* of the roll screw-down, superimposed to disturbance simulation $\Delta R''$, to summator 32, the dynamics of position control 20 have no influence on the compensation for roll eccentricities $\Delta R$, so that they are fully eliminated asymptotically in their effect on the exit thickness $h_a$ of the rolled material 8. This, however, is no longer true at high roll speeds, since in those cases and with simultaneously slower dynamics of position control 20, the entire control circuit may become unstable. Therefore, in order to avoid such instabilities, the delay of position control 20 is dynamically compensated through the aforementioned PD element 27. In order to make the disturbance value compensation complete (e=0), PT1 element 30 is provided. Instead of PD element 27 and PT1 element 30, a single PD element can be provided in the area where the thickness measuring signal $h_a'$ is processed between the thickness measuring device 18 and summator 32.

Figure 3:
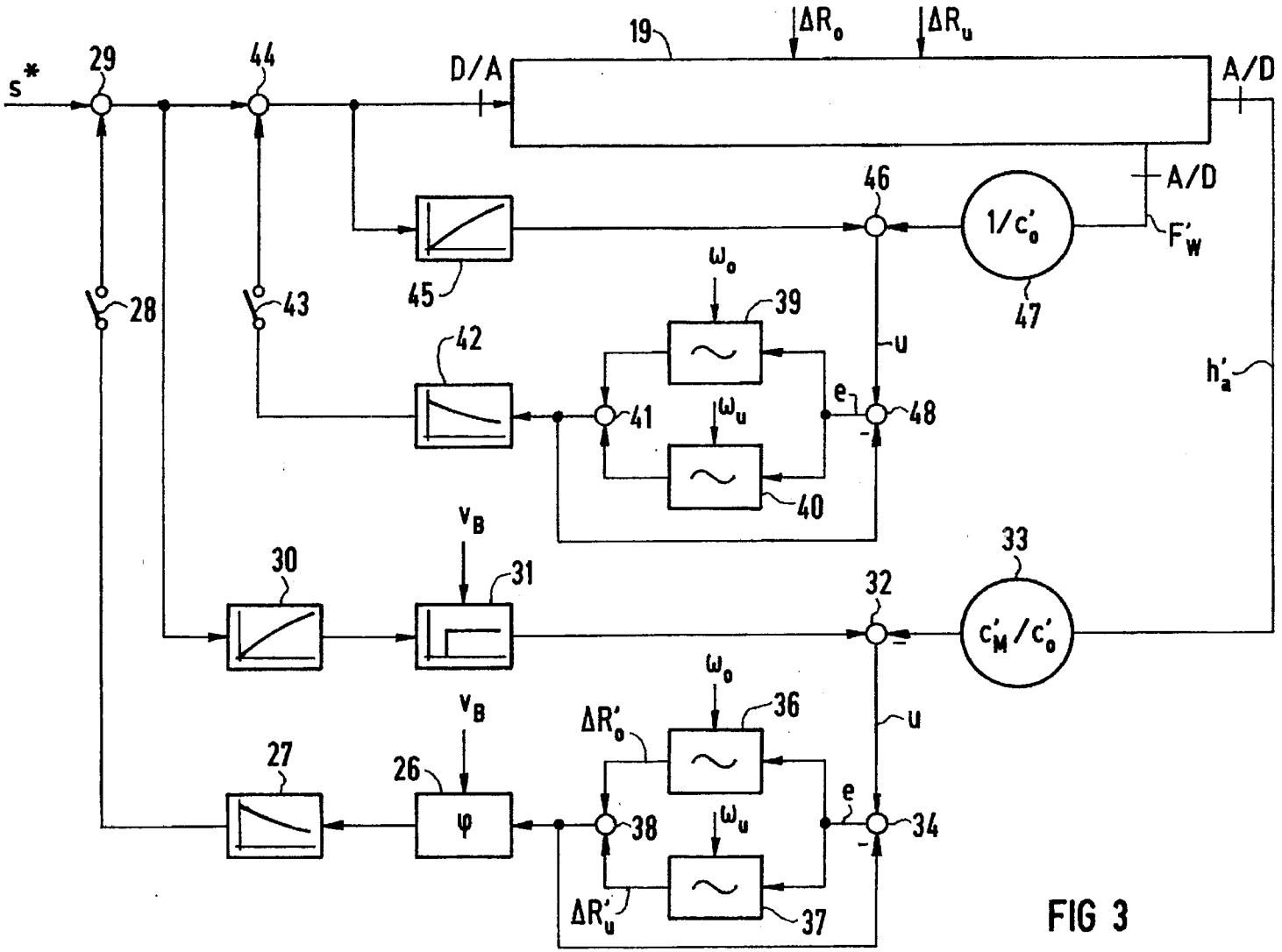
FIG. 3 is an extended version of the block diagram shown in FIG. 2.

FIG. 3 shows an extended version of the block diagram shown in FIG. 2, where 19 again denotes the controlled system, which has as an input the set value s* for the roll screw-down which is supplied through a digital/analog converter. Controlled system 19 supplies measured rolling force signal $F_W'$ and measured thickness signal $h_a'$, which are both converted to digital values by an analog/digital converter. Both rolling force $F_W$ and exit thickness $h_a$ of the rolled material 8 are affected in controlled system 19 by the roll eccentricities, which are slightly different for the upper and lower rolls of roll stand 1 due to the differences in diameter and are here designated with $\Delta R_o$ and $\Delta R_u$, respectively. To compensate for roll eccentricities $\Delta R_o$ and $\Delta R_u$ based on the measured thickness signal $h_a'$, two oscillators 36 and 37 are provided, coupled in a feedback loop. Oscillator 36 simulates disturbances $\Delta R_o$ originating from the upper rolls, while oscillator 37 simulates disturbances $\Delta R_u$ originating from the lower rolls. For this purpose, the frequency of oscillator 36 is set according to measured speed $n_o$ of the upper rolls with $\omega_o=2\pi n_o$ and the frequency of oscillator 37 is set according to measured speed $n_u$ of the lower rolls with $\omega_u=2\pi n_u$. The disturbance values $\Delta R_o'$ and $\Delta R_u'$ simulated by both oscillators 36 and 37 are summed in a summator 38 and combined with set value s* of roll screw-down in summator 29 through phase rotator 26, PD element 27, and switch 28, as well as supplied to summator 34 with a negative sign as feedback for both oscillators 36 and 37. Also, as in the example illustrated in FIG. 2, the set value of the roll screw-down $s^*+\Delta R_o'+\Delta R_u'$, affected by the disturbance value is supplied to summator 32 through PT1 element 30 and delay element 31, and the measured thickness signal $h_a'$ is supplied to summator 32 through multiplicator 33 to form difference signal u.

Compensation for roll eccentricities $\Delta R_o=\Delta R_u$ based on measured rolling force signal $F_W'$ is also provided. For this purpose, an oscillator 39 connected in a feedback loop, frequency-controlled with $\omega_o$, simulates disturbances $\Delta R_o$ originating from the upper rolls, while another oscillator, frequency-controlled with $\omega_u$, simulates disturbances $\Delta R_u$ originating from the lower rolls. The disturbance values simulated by both oscillators 39 and 40 are summed in summator 41 and are combined with set value s* of the roll screw-down in a summator 44 through PD element 42 and switch 43. The set value of the roll screw-down combined with the simulated disturbances, $s^*+\Delta R_o'+\Delta R_u'$, is supplied to a summator 46 through PT1 element 45 and there linked with a roller force signal $F_W'$ multiplied by the calculated inverse value $1/c_O'$ of the overall rigidity of the stand and material spring in multiplier 47 to form sum signal u. This sum signal u and the initial sum signal $\Delta R_o'+\Delta R_u'$ of the two oscillators 39 and 40 are compared in another summator 48 and the two oscillators 39 and 40 are corrected in amplitude and phase with the correction signal obtained e until the sum of the simulated disturbances $\Delta R_o'+\Delta R_u'$ and sum signal u are the same.

Figure 4:
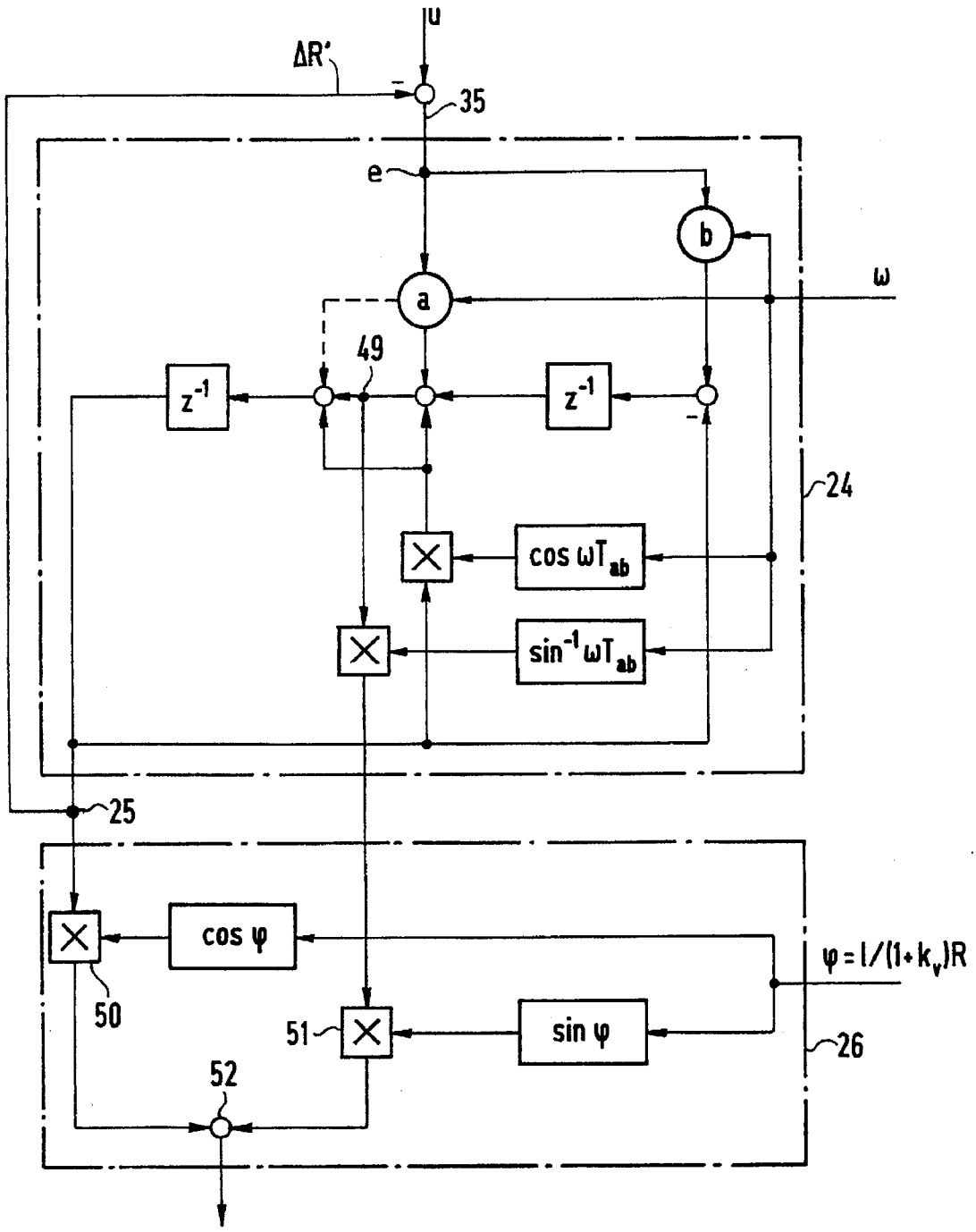
FIG. 4 is an example of the disturbance monitor with an oscillator connected in a feedback loop.

FIG. 4 shows a digital version of the oscillator 24 illustrated in FIG. 2 with a downstream phase rotator 26. The transfer function of the digital oscillator 24 connected in a feedback loop is:

$$\Delta R'/u=(at+b)/[z^2+z(a-2\cos\omega T_{ab})+b+1],$$

where $T_{ab}$ is the sampling period. As in an analog version of the oscillator, correction coefficients a and b determine the transient dynamics of oscillator 24 connected in a feedback loop, and the correction coefficients a and b can be set according to frequency $\omega$ of the fundamental frequency.

The sinusoidal output signal produced at output 25 of oscillator 24 and a corresponding cosinusoidal output signal produced at a switching point 49 in oscillator 24 are multiplied by factors cos $\phi$ and sin $\phi$, respectively, in multiplicators 50 and 51 and totalled in summator 52. Assuming constant speeds, the following applies for the phase shift:

$$\phi=\omega\cdot T_{tot}=(v_w/R)\cdot(l/v_B)=l/[(1+k_v)R],$$

where $T_{tot}$ is the measurement delay and 1 is the distance between the rolling gap and thickness measuring device 18, $v_W$ is the peripheral speed of the roll, $v_B$ is the exit speed of the rolled material 8 from the rolling gap, R is the radius of work rolls 4 and 5 and $k_v$ is the forward slip with $v_B/v_W=1+k_V$.

Figure 5:
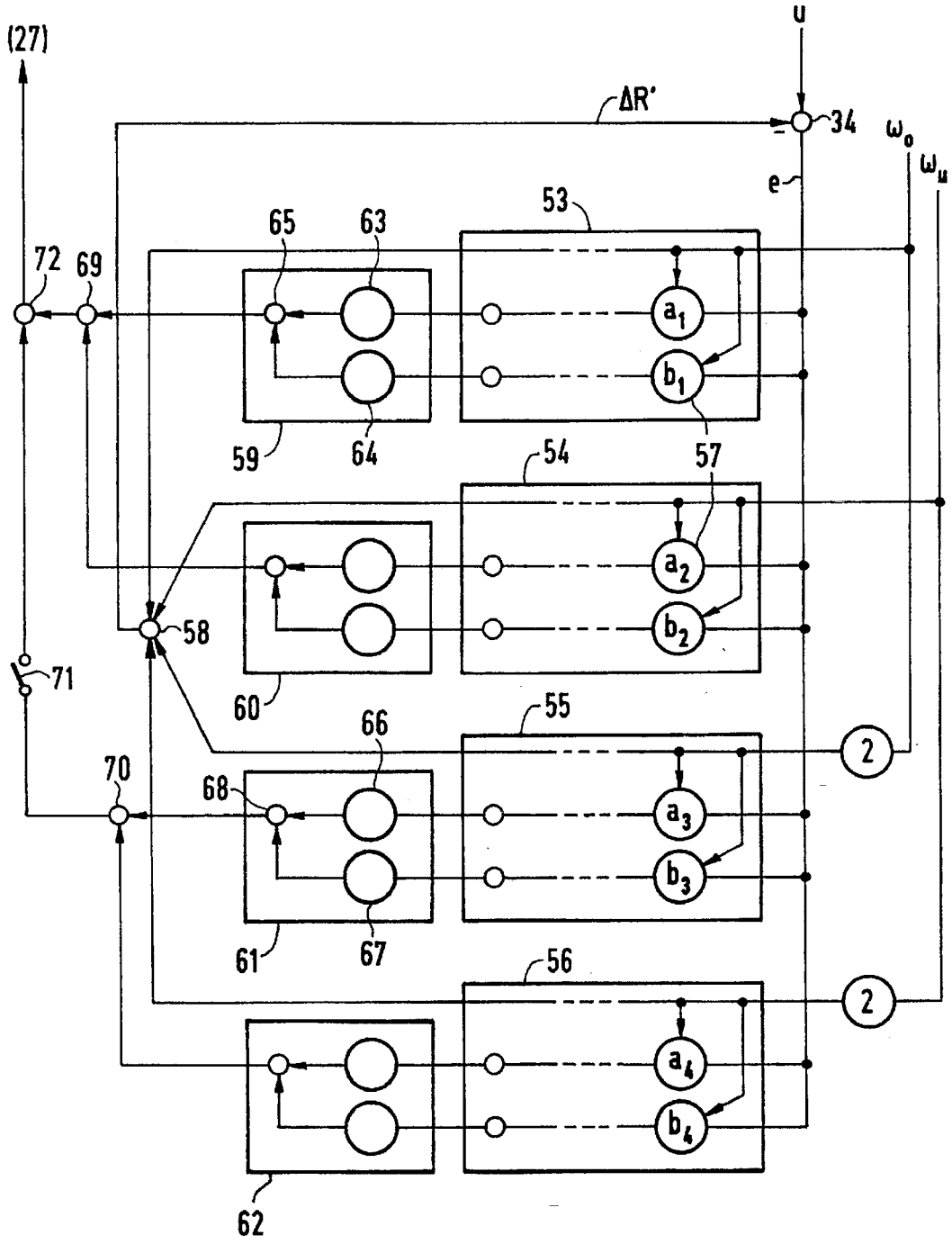
FIG. 5 is another example of the disturbance monitor with a plurality of oscillators connected in a feedback loop.

FIG. 5 shows another example of the disturbance monitor used for compensating for roll eccentricities based on the measured thickness signal $h_a'$. This disturbance monitor contains four oscillators 53, 54, 55, and 56, with oscillator 53 simulating fundamental frequency $\omega_o$ and oscillator 55 simulating the higher frequency $2\omega_o$ of the disturbances originating from the upper rolls, and with oscillator 54 simulating fundamental frequency $\omega_u$ and oscillator 56 simulating the higher frequency $2\omega_u$ of the disturbances originating from the lower rolls. The design of the individual oscillators 53 through 56 corresponds to that of oscillator 24 in FIG. 4. Therefore, in this figure, only adjusting elements 57 for the different correction coefficients $a_l$, $b_1$ through $a_4$, $b_4$ are illustrated. The difference e between the signal u and the simulated disturbance $\Delta R'$ are supplied as inputs to the adjusting elements 57 as was the case with oscillator 24 in FIG. 4. Simulated disturbance $\Delta R'$ is generated in a summator 58 from the sum of the output signals of oscillators 53 through 56; these output signals do not necessarily correspond to the signals applied to switching points 25 or 49, as can be seen by comparing FIGS. 4 and 5.

In the example illustrated, each oscillator 53 through 56 is followed by a phase rotator 59, 60, 61, and 62 to compensate for the measurement delay between the rolling gap and thickness measuring device 18. Each of phase rotators 59 and 60, connected downstream from oscillators 53 and 54 and used for simulating fundamental frequencies $\omega_o$ and $\omega_u$, contains two multiplicators 63 and 64, in which the sinusoidal signals are multiplied by cos $\phi$ at switching point 25 and the cosinusoidal signals are multiplied by sin $\phi$ at switching point 49; then both signals are summed in summator 65. Each of the two phase rotators 61 and 62, connected downstream from oscillators 55 and 56 and used for simulating higher frequencies $2\omega_o$ and $2\omega_u$, respectively, also contain two multiplicators 66 and 67, in which the sinusoidal signal is multiplied by cos $2\omega$ at switching point 25 and the cosinusoidal signal is multiplied by sin $2\omega$ at switching point 49; then both signals are totalled in a summator 68. The output signals of phase rotators 59 and 60 are totalled in a summator 69 and supplied to the position or thickness control according to the illustration of FIG. 2 or FIG. 3. The output signals of phase rotators 61 and 62 are also totalled in a summator 70 and, if needed, are also supplied to the position or thickness control through a switch 71 and another summator 72.

What is claimed is:

1. A method for suppressing the influence of roll eccentricities on the exit thickness of a rolled material in a roll stand, said method comprising:

simulating the roll eccentricities as an output signal of a first oscillator coupled in a feedback loop;

supplying the output signal of said first oscillator to a position control for the roll stand, where the frequency of said output signal is set according to a measured rotation speed of rolls in said roll stand, and an amplitude and phase of said output signal are set such that the exit thickness of the rolled material is measured after its exit from the roll stand with a measurement delay in relation to a thickness reduction in the roll stand;

generating a signal corresponding to a roll screw-down value which is delayed by at least approximately the amount of said measurement delay;

generating a difference signal from the delayed roll screw-down signal and a sum of the measured thickness signal multiplied by the sum of one and the quotient of a rigidity of the rolled material and a rigidity of the roll stand;

correcting the amplitude and phase of the output signal of said first oscillator in dependence on a difference between the output signal of said first oscillator and said difference signal to minimize said difference; and phase shifting the output signal of said first oscillator by an amount corresponding to the measurement delay for a forward slip.

2. The method of claim 1 wherein a set value of the roll screw-down is used as said roll screw-down signal.

3. The method of claim 2, wherein said measured thickness signal for generation of said difference signal is passed through a proportional-differential element.

4. The method of claim 2, wherein the phase-shifted output signal of said first oscillator is supplied to said position control through a proportional-differential element and the roll screw-down signal for generation of said difference signal is passed through a proportional-delay element.

5. The method of claim 4 wherein said position control has a digital design and said first oscillator, said roll screw-down signal, said measured thickness signal and said measured speed of the rolls of said roll stand are at least converted into digital values.

6. The method of claim 2 wherein said position control has a digital design and said first oscillator, said roll screw-down signal, said measured thickness signal and said measured speed of the rolls of said roll stand are at least converted into digital values.

7. The method of claim 5 wherein a second oscillator is connected in a feedback loop to simulate roll eccentricities as an output signal of said second oscillator, said method further comprising:

setting a frequency of an output signal of said first oscillator according to a rotation speed of the upper rolls of said roll stand;

setting a frequency of an output signal of said second oscillator according to a rotation speed of the lower rolls of said roll stand; and additively linking the output signals of said first and second oscillators.

8. The method of claim 7 wherein third and fourth oscillators are coupled in a feedback loop, said method further comprising:

suppressing higher frequencies of said roll eccentricities in said third and fourth oscillators; and additively linking the output signals of said third and fourth oscillators.

9. The method of claim 8, further comprising:

simulating the roll eccentricities by the output signal of at least one additional oscillator; and supplying the output signal of said additional oscillator to the position control;

such that a frequency of the output signal of said additional oscillator is set according to the measured rotation speed of the rolls of the roll stand, and the amplitude and phase of the output signal of said additional oscillator is corrected according to a difference between said output signal of said additional oscillator and a sum signal of the measured rolling force multiplied by a sum of the inverse values of the rigidity of the roll stand and the rolled material, and the roll screw-down to minimize said difference.

10. The method of claim 2 wherein a second oscillator is connected in a feedback loop to simulate roll eccentricities as an output signal of said second oscillator, said method further comprising:

setting a frequency of an output signal of said first oscillator according to a rotation speed of the upper rolls of said roll stand;

setting a frequency of an output signal of said second oscillator according to a rotation speed of the lower rolls of said roll stand; and additively linking the output signals of said first and second oscillators.

11. The method of claim 2 wherein third and fourth oscillators are coupled in a feedback loop, said method further comprising:

suppressing higher frequencies of said roll eccentricities in said third and fourth oscillators; and additively linking the output signals of said third and fourth oscillators.

12. The method of claim 2, further comprising:

simulating the roll eccentricities by the output signal of at least one additional oscillator; and supplying the output signal of said additional oscillator to the position control;

such that a frequency of the output signal of said additional oscillator is set according to the measured rotation speed of the rolls of the roll stand, and the amplitude and phase of the output signal of said additional oscillator is corrected according to a difference between said output signal of said additional oscillator and a sum signal of the measured rolling force multiplied by a sum of the inverse values of the rigidity of the roll stand and the rolled material, and the roll screw-down to minimize said difference.

13. The method of claim 1, wherein said measured thickness signal for generation of said difference signal is passed through a proportional-differential element.

14. The method of claim 1, wherein the phase-shifted output signal of said first oscillator is supplied to said position control through a proportional-differential element and the roll screw-down signal for generation of said difference signal is passed through a proportional-delay element.

15. The method of claim 1 wherein said position control has a digital design and said first oscillator, said roll screw-down signal, said measured thickness signal and said measured speed of the rolls of said roll stand are at least converted into digital values.

16. The method of claim 1 wherein a second oscillator is connected in a feedback loop to simulate roll eccentricities as an output signal of said second oscillator, said method further comprising:

setting a frequency of an output signal of said first oscillator according to a rotation speed of the upper rolls of said roll stand;

setting a frequency of an output signal of said second oscillator according to a rotation speed of the lower rolls of said roll stand; and additively linking the output signals of said first and second oscillators.

17. The method of claim 1 wherein third and fourth oscillators are coupled in a feedback loop, said method further comprising:

suppressing higher frequencies of said roll eccentricities in said third and fourth oscillators; and additively linking the output signals of said third and fourth oscillators.

18. The method of claim 1, further comprising:

simulating the roll eccentricities by the output signal of at least one additional oscillator; and supplying the output signal of said additional oscillator to the position control;

such that a frequency of the output signal of said additional oscillator is set according to the measured rotation speed of the rolls of the roll stand, and the amplitude and phase of the output signal of said additional oscillator is corrected according to a difference between said output signal of said additional oscillator and a sum signal of the measured rolling force multiplied by a sum of the inverse values of the rigidity of the roll stand and the rolled material, and the roll screw-down to minimize said difference.

* * * * *